US006652196B1

(12) United States Patent
Rainey

(10) Patent No.: US 6,652,196 B1
(45) **Date of Patent: *Nov. 25, 2003**

(54) RETAINING WALL ANCHORING SYSTEM

(75) Inventor: Thomas L. Rainey, Acworth, GA (US)

(73) Assignee: Anchor Wall Systems Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/698,934

(22) Filed: Oct. 27, 2000

Related U.S. Application Data

(63) Continuation of application No. 09/261,420, filed on Mar. 3, 1999, now Pat. No. 6,168,351.

(51) Int. Cl.[7] ..... F02D 29/02
(52) U.S. Cl. ..... 405/262; 405/284; 405/286
(58) Field of Search ..... 405/262, 284, 405/285, 286

(56) References Cited

U.S. PATENT DOCUMENTS 1,947,151 A * 2/1934 Caples ..... 405/262
2,110,253 A * 3/1938 Nedden ..... 405/262
4,448,571 A * 5/1984 Eckels ..... 405/262
4,911,582 A * 3/1990 Peirce, Jr. et al. ..... 405/262
5,368,414 A * 11/1994 Miller ..... 405/262
5,588,784 A * 12/1996 Brandl et al. ..... 405/262
5,921,715 A * 7/1999 Rainey ..... 405/262
6,050,749 A * 4/2000 Khamis ..... 405/286
6,086,288 A * 7/2000 Ruel et al. ..... 405/262
6,089,792 A * 7/2000 Khamis ..... 405/262
6,168,351 B1 * 1/2001 Rainey ..... 405/262

* cited by examiner

*Primary Examiner*—Frederick L. Lagman
(74) *Attorney, Agent, or Firm*—Thomas, Kayden, Horstemeyer & Risley, LLP

(57) ABSTRACT

A retaining wall anchoring system for a segmental retaining wall comprising a plurality of tieback rods adapted to be embedded into soil or rock with a proximal portion extending therefrom, at least one elongated force distribution member positionable directly adjacent the proximal portion of at least one of the tieback rods, a washer positionable about the proximal portions of the tieback rod in abutment with the force distribution member, and a fastener fixedly securable to the proximal portion of the tieback rod to securely clamp the washer against the force distribution member such that tensile forces imposed on the tieback rod are transmitted to the force distribution member so as to distribute these forces throughout a portion of the retaining wall.

23 Claims, 4 Drawing Sheets

RETAINING WALL ANCHORING SYSTEM

CROSS REFERENCE TO RELATED APPLICATION

This application is a continuation of U.S. patent application Ser. No. 09/261,420, filed Mar. 3, 1999, entitled "Retaining Wall Anchoring System," now U.S. Pat. No. 6,168,351, which, in turn, claims the benefit of the filing date of U.S. patent application Ser. No. 08/846,440, filed Apr. 30, 1997, entitled "Retaining Wall and Method," now U.S. Pat. No. 5,921,715, both of which are incorporated by reference in their entireties into the present disclosure.

FIELD OF THE INVENTION

The invention relates generally to earth reinforcement. More particularly, the invention relates to a segmental retaining wall anchoring system for securing segmental retaining walls.

BACKGROUND OF THE INVENTION

Segmental earth retaining walls are commonly used for architectural and site development applications. Such walls are subjected to very high pressures exerted by lateral movements of the s oil, temperature and shrinkage effects, and seismic loads. Therefore, the backfill soil typically must be braced with tensile reinforcement members.

Often, elongated structures, commonly referred to as geogrids or reinforcement fabrics, are used to provide this reinforcement. Geogrids often are configured in a lattice arrangement and are constructed of a metal or polymer, while reinforcement fabrics are constructed of woven or nonwoven polymers (e.g., polymer fibers). These reinforcement members typically extend rearwardly from the wall and into the soil. The weight of the soil constrains the fabric from lateral movement to thereby stabilize the retaining wall.

SUMMARY OF THE INVENTION

Briefly described, the present invention relates to a retaining wall anchoring system for a segmental retaining wall comprising a plurality of tieback rods adapted to be embedded into soil or rock with a proximal portion extending therefrom. The system includes at least one elongated force distribution member positionable directly adjacent the proximal portion of the tieback rods, at least one washer positionable about the proximal portions of at least one tieback rod in abutment with the force distribution member, and at least one fastener fixedly securable to the proximal portion of the tieback rod to securely clamp the washer against the force distribution member such that tensile forces imposed on the tieback rod are transmitted to the distribution member so as to distribute these forces throughout a portion of the retaining wall.

The above described apparatus therefore can be used to construct a segmental retaining wall system comprising a retaining wall having a plurality of wall blocks stacked in ascending courses with a plurality of the wall blocks being provided with interior openings that are aligned with each other to form an inner passageway within the retaining wall. The proximal portion of each tieback rod can be extended into the inner passageway formed within the retaining wall with the elongated force distribution member positioned within the inner passageway directly adjacent the proximal portion of at least one of the tieback rods, a washer positioned about the distal portion of the tieback rods in abutment with the force distribution member, and a fastener fixedly secured to the proximal portion of the tieback rods to securely clamp the washer against the force distribution member such that tensile forces imposed on the tieback rods are transmitted to the force distribution member so as to distribute the tensile forces throughout a portion of the retaining wall.

In addition, the apparatus can be used to construct a segmental retaining wall system comprising a retaining wall having a plurality of wall blocks stacked in ascending courses to form an interior surface and an exterior surface, a plurality of tieback rods adapted to be embedded into soil or rock with a proximal portion extending therefrom, the proximal portion of each tieback rod extending toward the interior surface of the retaining wall, at least one elongated force distribution member positioned adjacent the interior surface of the retaining wall and directly adjacent the proximal portion of at least one tieback rod, a washer positioned about the distal portion of the tieback rod in abutment with the force distribution member, a fastener fixedly secured to the proximal portion of the tieback rod to securely clamp the washer against the force distribution member, and a reinforcement member connected to the force distribution member and being securely attached to the retaining wall such that tensile forces imposed on the tieback rods are transmitted to the force distribution member and through the reinforcement member to the retaining wall so as to distribute the tensile forces throughout a portion of the retaining wall.

DETAILED DESCRIPTION

Figure 1:
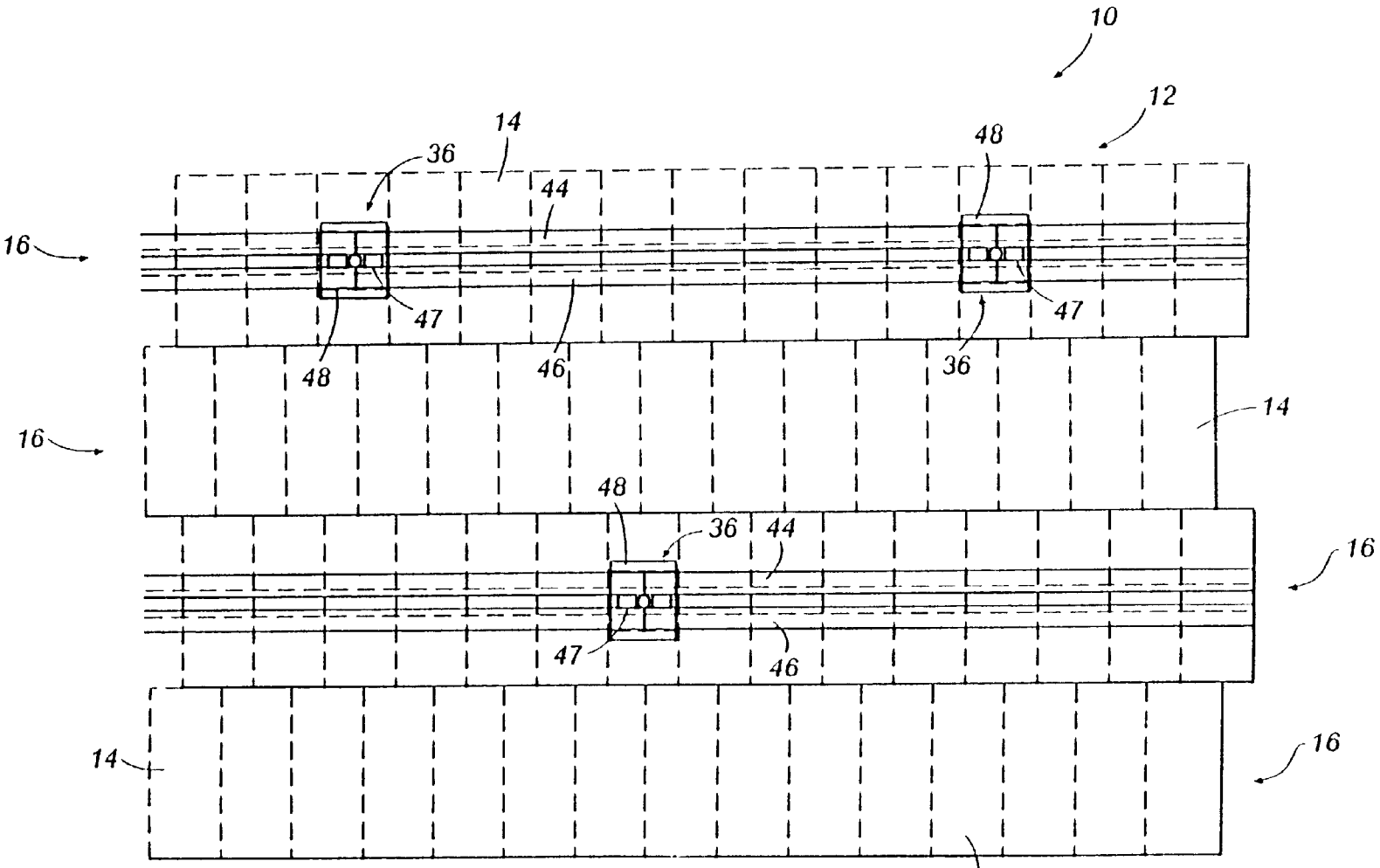
FIG. 1 is a front view of a retaining wall secured with an anchoring system constructed in accordance with the present invention.
Figure 3:
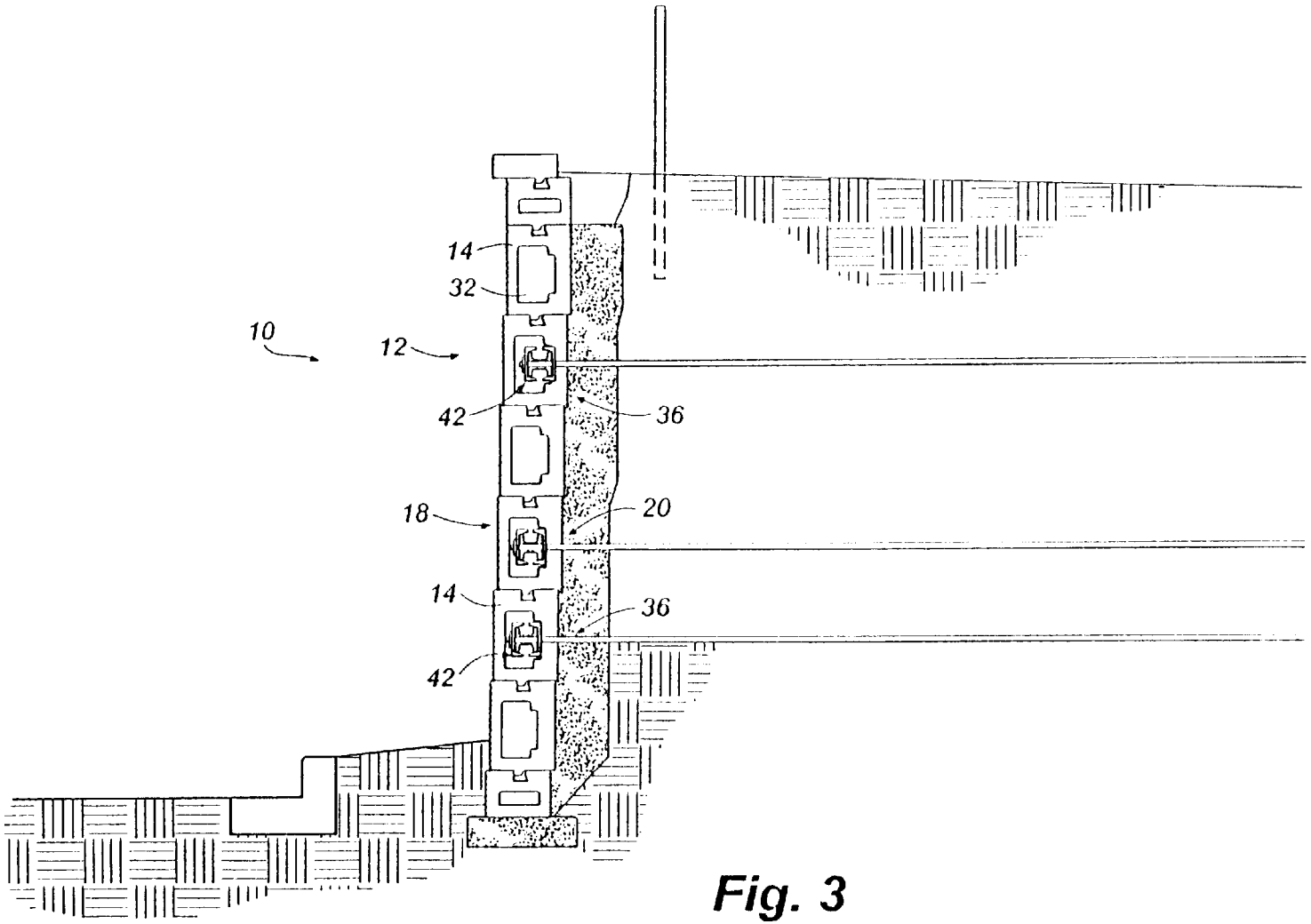
FIG. 3 is a partial cross-sectional view of a retaining wall secured with an anchoring system constructed in accordance with the present invention.

Referring now in detail to the drawings, in which like numerals indicate corresponding parts throughout the several views, FIG. 1 illustrates a modular retaining wall 10 secured with a first embodiment 12 of an anchoring system constructed in accordance with the present invention. As depicted in this figure, the retaining wall 10 comprises a plurality of wall blocks 14 that are stacked atop each other in ascending courses 16. When stacked in this manner, the wall blocks 14 together form an exterior surface 18 of the wall 10 which faces outwardly away from an earth embankment, and an interior surface 20 of the wall 10 which faces inwardly toward the embankment (FIG. 3). Typically, the blocks 14 are stacked in a staggered arrangement as shown in FIG. 1 to provide greater stability to the wall 10.

Generally speaking, the blocks 14 are substantially identical in size and shape for ease of block fabrication and wall construction, although it will be understood that unidentical blocks could be used, especially for cap blocks or base blocks. In a preferred configuration, each block 14 is configured so as to mate with at least one other block 14 when the blocks are stacked atop one another to form the retaining wall 10. This mating restricts relative movement between vertically adjacent blocks in at least one horizontal direction. To provide for this mating, the blocks 14 can include locking means 22 that secure the blocks together to further increase wall stability. More particularly, each block 14 can include a lock channel 24 and a lock flange 26 that are configured so as to positively lock with each other when the blocks 14 are stacked on top of each another as disclosed in co-pending U.S. application Ser. No. 09/049,627, which is hereby incorporated by reference into the present disclosure. When the blocks 14 include lock channels 24 and flanges 26, the individual lock channels typically form a continuous lock channel that extends the length of the lower of two mating courses when the blocks are aligned side-by-side within each course 16. Similarly, the lock flanges 26 form a continuous lock flange that extends the length of the upper of the mating courses 16 which is received by the continuous lock channel of the lower of the mating courses.

Although the blocks 14 preferably are provided with such locking means 22, it will be appreciated that the anchoring system of the present invention can be used with substantially any segmental retaining wall blocks. By way of example, the present system could be used with any of the blocks produced by Anchor Wall Systems, Inc. such as any block of the Anchor Diamond® and/or Anchor Vertica® product lines, or any block disclosed in U.S. Pat. No. 5,827,015, which is hereby incorporated by reference into the present disclosure. Moreover, the present system could be utilized with the segmental blocks produced by other manufacturers such as Keystone, Mesa, Versa-Lok, Newcastle, and Piza. Irrespective of the particular configuration of the wall blocks 14, each of the wall blocks typically includes an interior opening 32 that either extends through the block horizontally (side-to-side) or vertically (top-to-bottom). When the blocks 14 are correctly aligned in their respective courses 16, these openings 32 form continuous elongated passageways 34. In that, as described below, the passageways 34 typically are only used for anchoring system attachment, it is to be appreciated that only the blocks 14 that receive the system's components need be provided with such openings 32.

Figure 2:
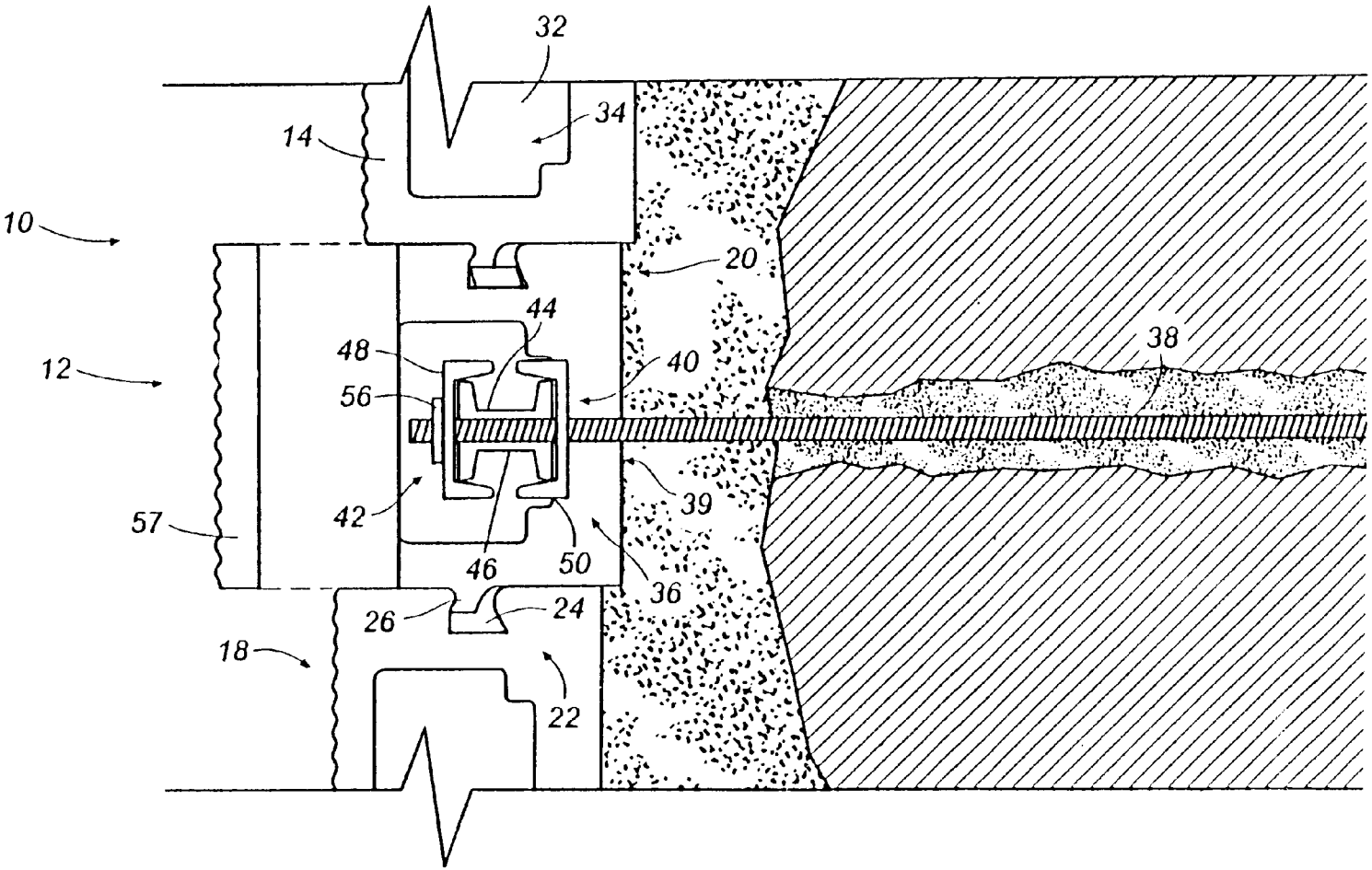
FIG. 2 is a partial cross-sectional view of a retaining wall which shows a tieback connection of an anchoring system constructed in accordance with the present invention.

As indicated in FIGS. 1–3, the retaining wall 10 is secured in several predetermined points with tieback connections 36. Typically, each tieback connection 36 is spaced approximately 10 feet apart horizontally from each other to form rows of tieback connections that are approximately 2.5 feet apart vertically from each other. Accordingly, each tieback rod 38 is embedded into the soil and/or rock in these intervals. As shown in FIG. 2, each tieback rod 38 extends through an opening 39 formed in the rear surface of its respective wall block 14 such that a proximal portion 40 of the rod 38 extends into the continuous elongated passageway. Also positioned within the passageway 34 is a tieback rod attachment mechanism 42. The attachment mechanism 42 normally includes a pair of elongated force distribution members 44, 46 that extend from one tieback rod 26 to the next along the passageway 34 and which are positioned above and below the tieback rods 38 as indicated in FIG. 1. Typically, each force distribution member 44, 46 comprises an elongated channel beam that is flanged so as to cooperate more readily with washers described below. Arranged in this manner, each passageway 34 having tieback rods 38 extending therein includes a plurality of force distribution members 44, 46 aligned end to end both above and below the rods. To maintain parallel spacing between the force distribution members 44, 46, the attachment mechanism 42 can include spacers 47 that are positioned adjacent each rod 38 on both sides of the rod as indicated in FIG. 1. Normally, the height of these spacers 47 generally approximates the diameter of the tieback rods 38.

As shown in FIG. 2, a pair of flanged washers 48, 50 partially surround the upper and lower pairs of force distribution members 44 and 46, and are fitted about each tieback bar 38. To accommodate the rearmost 50 of the washers, each wall block 14 accommodating a tieback rod 38 normally is provided with an inner channel 54 that is sized and configured for receipt of the washer 50. Threaded onto each tieback rod 38 is a conventional threaded fastener 56 such as a nut which, when fully tightened, urges the washers 48, 50 inwardly to securely hold the force distribution members 44, 46 in position, thereby securing the rod to the wall 10. Normally, this tightening is achieved by accessing the interior of the block 14 by removing a face covering portion 57 of the block. Once fully tightened, the fastener 56 can be bonded in place with epoxy to prevent its inadvertent loosening. After the fastener 56 has been fixed in place, the face covering portion 57 of the block 14 can be secured to the block so that it matches the other blocks forming the wall. Configured in this manner, each tieback connection 36 evenly distributes any forces exerted on the tieback rods 38 throughout the wall 10 to greatly improve wall integrity.

Figure 4:
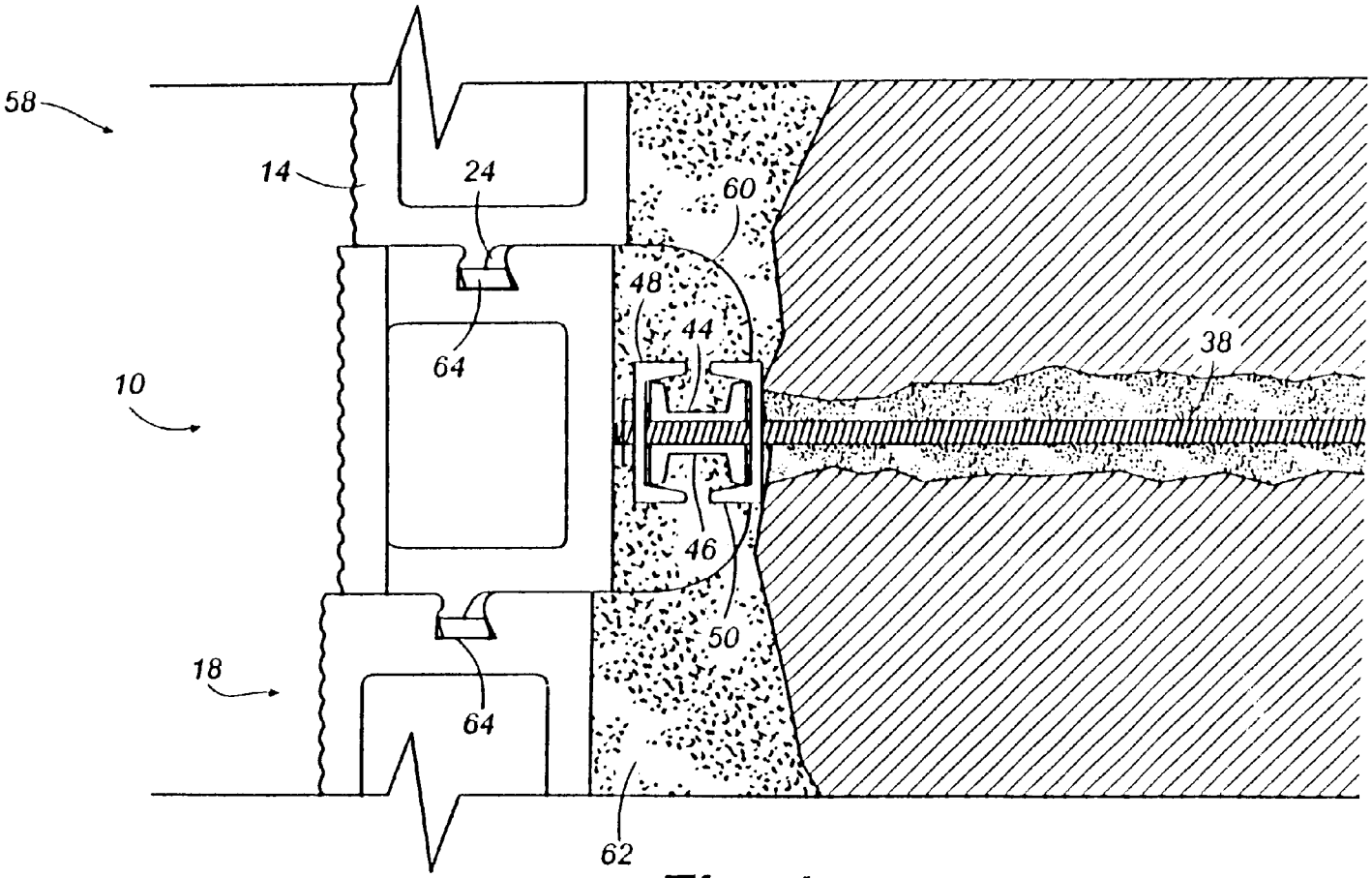
FIG. 4 is a partial cross-sectional view of a retaining wall which shows a tieback connection of an anchoring system constructed in accordance with the present invention.

FIG. 4 illustrates a second embodiment 58 of an anchoring system constructed in accordance with the present invention. This embodiment is structurally similar to the system depicted in FIGS. 1–3 and described above. Accordingly, the force distribution members 44, 46, flanged washers 48, 50, as well as the fastener 56, are used to secure the tieback rods 38 to the wall 10. However, in this embodiment, the rods 38 are secured with a reinforcement member 60 such as a geogrid wrap instead of directly to a wall block 14 such that the reinforcement member 60 is positioned outside of but adjacent to the interior surface 20 of the wall. Because of this arrangement, the blocks 14 need not comprise interior openings 32, as in the first embodiment. Preferred for the construction of the reinforcement member 60 is geogrid material that comprises flexible fabric composed of a polymeric material such as polypropylene or high tenacity polyester. As shown most clearly in FIG. 4, the reinforcement member 60 extends from the exterior surface 18 of the retaining wall 10, into a lock channel 24 of the lower adjacent wall block 14, out from the wall and into a portion of the stone fill 62 formed between the wall and the soil and/or rock, wraps around the force distribution members 44, 46, and then extends back underneath the upper adjacent block 14 (into the wall), into the lock channel 24 of the upper adjacent block, and back to the exterior surface of the wall 18, tracing a substantially C-shaped path.

In the wall system illustrated in FIG. 4, the reinforcement member 60 is locked to the wall 10 with a pair of retaining bars 64 that are positioned in the two lock channels 24 adjacent the tieback rod 38. These retaining bars 64 lie atop the reinforcement member 60 and holds it against the rear walls of the locking channels 24 to prevent the reinforcement member from being pulled out from the retaining wall 10. Although such retaining means are preferred, it will be understood that other types of retaining means could be used. When a tensile force is applied to the tieback rod 38 and translated to the reinforcement member 60, the retaining bars 64 are urged towards the rear wall of the channels 24, locking the reinforcement member in place. Thus, like the system of the first embodiment, the anchoring system of the second embodiment similarly distributes the forces exerted by the soil and/or rock of the embankment throughout the retaining wall 10.

While preferred embodiments of the invention have been disclosed in detail in the foregoing description and drawings, it will be understood by those skilled in the art that variations and modifications thereof can be made without departing from the spirit and scope of the invention. For instance, although the anchoring system of the first embodiment herein is described and shown in use with a retaining wall having horizontal inner passageways, it is to be appreciated that this systems easily could be adapted for use with a retaining wall having vertical inner passageways.

What is claimed is:

1. A retaining wall anchoring system for a segmental retaining wall having a transverse passageway formed therein, comprising:

at least one tieback rod adapted to be embedded into soil or rock with a proximal portion of said at least one tieback rod extending into the wall passageway; and a force distribution member adapted to be positioned directly adjacent said proximal portion of said at least one tieback rod within the passageway;

wherein tensile forces imposed on said at least one tieback rod are transmitted to said force distribution member so as to distribute the tensile forces throughout a portion of the retaining wall.

2. The system of claim 1, further comprising at least one washer positionable about said proximal portion of said at least one tieback rod in abutment with said force distribution member.

3. The system of claim 1, further comprising at least one fastener fixedly secured to said proximal portion of said at least one tieback rod that securely clamps said force distribution member to said at least one tieback rod.

4. The system of claim 3, wherein said proximal portion of said at least one tieback rod is threaded and said at least one fastener comprises at least one threaded nut.

5. The system of claim 1, wherein said system includes at least two force distribution members adapted to be positioned on opposite sides of said at least one tieback rod.

6. The system of claim 5, further comprising at least one spacer positionable between said force distribution members that maintains parallel spacing between said force distribution members.

7. The system of claim 1, wherein said force distribution member is an elongated channel beam.

8. The system of claim 7, wherein said elongated channel beam is flanged.

9. The system of claim 1, further comprising two washers being positionable on opposite sides of said force distribution member so as to clamp said force distribution member therebetween.

10. The system of claim 9, wherein each washer is flanged so as to partially surround said force distribution member.

11. A segmental retaining wall, comprising:

a transverse passageway formed within said wall;

a plurality of tieback rods adapted to be embedded into soil or rock and each having a proximal portion extending into said passageway; and a force distribution member positioned within said transverse passageway directly adjacent said proximal portions of said tieback rods;

wherein tensile forces imposed upon said tieback rods are transmitted to said force distribution member so as to distribute the tensile forces throughout a portion of said retaining wall.

12. The wall of claim 11, further comprising a plurality of washers positioned about said proximal portions of said tieback rods in abutment with said force distribution member.

13. The wall of claim 11, further comprising a plurality of fasteners fixedly secured to said proximal portions of said tieback rods that securely clamp said force distribution member to at least one of said tieback rods.

14. The wall of claim 13, wherein said proximal portions of said tieback rods are threaded and said fasteners comprise threaded nuts.

15. The wall of claim 11, wherein said wall includes at least two force distribution members disposed within said passage on opposite sides of one of said tieback rods.

16. The wall of claim 15, further comprising spacers positioned between said force distribution members that maintain parallel spacing between said force distribution members.

17. The wall of claim 11, wherein said force distribution member is an elongated channel beam.

18. The wall of claim 17, wherein said elongated channel beam is flanged.

19. The wall of claim 11, further comprising a plurality of washers positioned on opposite sides of said force distribution member so as to clamp said force distribution member therebetween.

20. The wall of claim 19, wherein each washer is flanged so as to partially surround said force distribution member.

21. The wall of claim 11, wherein said retaining wall comprises a plurality of blocks stacked in courses.

22. The wall of claim 21, wherein said blocks in one of said courses includes said transverse passageway.

23. The wall of claim 21, wherein said blocks include complementary lock channels and flanges that cooperate when said blocks are stacked in courses to restrict relative movement between vertically adjacent blocks.

* * * * *

UNITED STATES PATENT AND TRADEMARK OFFICE

CERTIFICATE OF CORRECTION

PATENT NO. : 6,652,196 B1
DATED : November 25, 2003
INVENTOR(S) : Rainey

It is certified that error appears in the above-identified patent and that said Letters Patent is hereby corrected as shown below:

Title page,
Item [63], Related U.S. Application Data, "Continuation of application No. 09/261,420, filed on Mar. 3, 1999, now U.S. No. 6,168,351." should read
-- Continuation of application No. 09/261,420, filed on Mar. 3, 1999, now U.S. Pat. No. 6,168,351, which is a continuation-in-part of application No. 08/846,440, filed on Apr. 30, 1997, now U.S. Pat. No. 5,921,715 and a continuation-in-part of U.S. patent application Ser. No. 09/049,627, filed Mar. 27, 1998, now U.S. Pat. No. 6,338,597, and which claims the benefit of Provisional application No. 60/086,843 filed on May 27, 1998. --

Column 1,
Lines 8-13, ""Retaining Wall Anchoring Systems," now U.S. Pat. No. 6,168,351, which, in turn, claims the benefit of the filing date of U.S. patent application Ser. No. 08/846,440, filed Apr. 30, 1997 entitled "Retaining Wall and Method", now U.S. Pat. No. 5,921,715, both of which are incorporated by reference in their entireties into the present disclosure." should read -- "Retaining Wall Anchoring System", now U.S. Pat. No. 6,168,351, which is a continuation-in-part of U.S. patent application Ser. No. 08/846,440, filed Apr. 30, 1997 entitled "Retaining Wall and Method", now U.S. Pat. No. 5,921,715, both of which are incorporated by reference in their entireties into the present disclosure. And U.S. patent application Ser. No. 09/261,420 is a continuation-in-part of U.S. patent application Ser. No. 09/049,627, filed Mar. 27, 1998, now U.S. Pat. No. 6,338,597, and claims the benefit of the filing date of Provisional application No. 60/086,846, filed May 27, 1998. --

Signed and Sealed this

First Day of March, 2005

JON W. DUDAS
*Director of the United States Patent and Trademark Office*